US009803514B2

(12) United States Patent
Mueller

(10) Patent No.: US 9,803,514 B2
(45) Date of Patent: Oct. 31, 2017

(54) SHAFT, PARTICULARLY A PARTLY TUBULAR CAMSHAFT

(75) Inventor: Ulf Mueller, Chemnitz (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 304 days.

(21) Appl. No.: 13/979,401

(22) PCT Filed: Feb. 2, 2012

(86) PCT No.: PCT/EP2012/051800

§ 371 (c)(1),
(2), (4) Date: Sep. 23, 2013

(87) PCT Pub. No.: WO2012/104391

PCT Pub. Date: Aug. 9, 2012

(65) Prior Publication Data

US 2014/0007736 A1 Jan. 9, 2014

(30) Foreign Application Priority Data

Feb. 2, 2011 (DE) ..... 10 2011 000 458

(51) Int. Cl.

| | |
|---|---|
| ***F01L 1/047*** | (2006.01) |
| ***F01L 1/46*** | (2006.01) |
| ***F01M 13/04*** | (2006.01) |
| ***F02B 67/06*** | (2006.01) |

(52) U.S. Cl.

CPC ..... *F01L 1/047* (2013.01); *F01L 1/46* (2013.01); *F01M 13/04* (2013.01); *F02B 67/06* (2013.01); *F01L 2001/0475* (2013.01); *F01L 2001/0476* (2013.01); *F01M 2013/0422* (2013.01); *Y10T 74/2101* (2015.01)

(58) Field of Classification Search

CPC .. Y10T 74/2101; Y10T 74/2102; F10L 1/047; F10L 1/344; F10L 1/3442; F10L 2001/0475; F01M 13/04; F01M 13/0416; F01M 2013/0422; B01D 45/14; B01D 45/16; B01D 45/12; F01L 2001/3521; F01L 1/46; F01L 2001/0476; F02B 67/06

See application file for complete search history.

(56) References Cited

U.S. PATENT DOCUMENTS

| | | | | |
|---|---|---|---|---|
| 3,561,195 A | | 2/1971 | Bouru | |
| 4,217,120 A | * | 8/1980 | Reynolds | 55/385.1 |
| 4,714,139 A | | 12/1987 | Lorenz | |
| 5,114,446 A | * | 5/1992 | Giersdorf et al. | 55/345 |

(Continued)

FOREIGN PATENT DOCUMENTS

| | | | | |
|---|---|---|---|---|
| DE | WO 2010102688 A1 | * | 9/2010 | F01L 1/047 |
| EP | 1880085 B | | 8/2010 | |
| LI | DE 102009012402 A1 | * | 9/2010 | F01L 1/047 |

*Primary Examiner* — Daniel Yabut
(74) *Attorney, Agent, or Firm* — Andrew Wilford

(57) ABSTRACT

The invention relates to a shaft, particularly a cam shaft (1), comprising a hollow shaft section (10) with at least one radial inlet opening (11*a*, 11*b*) for evacuating a gas through said hollow shaft section (10), and comprising a splash-guard device (4) arranged in the region of the radial inlet opening (11*a*, 11*b*) on the hollow shaft section (10). According to the invention, the splash-guard device (4) has a radially exposed cover with radial passage openings (8) and protrusions between said passage openings (8). The protrusions can, in particular, be in the form of ribs (9).

12 Claims, 3 Drawing Sheets

(56) References Cited

U.S. PATENT DOCUMENTS

| | | | | |
|---|---|---|---|---|
| 5,273,163 | A * | 12/1993 | Nichols | 209/714 |
| 5,954,035 | A | 9/1999 | Hofer | |
| 7,717,101 | B2 | 5/2010 | Beetz | |
| 2002/0083933 | A1* | 7/2002 | Schmid et al. | 123/572 |
| 2007/0294986 | A1* | 12/2007 | Beetz et al. | 55/385.3 |
| 2010/0236506 | A1* | 9/2010 | Meintschel et al. | 123/90.16 |
| 2011/0312427 | A1* | 12/2011 | Meusel et al. | 464/183 |

* cited by examiner

SHAFT, PARTICULARLY A PARTLY TUBULAR CAMSHAFT

CROSS REFERENCE TO RELATED APPLICATIONS

This application is the US-national stage of PCT application PCT/EP2012/051800 filed 2 Feb. 2012 and claiming the priority of German patent application 102011000458.0 itself filed 2 Feb. 2011.

FIELD OF THE INVENTION

The invention relates to a shaft, in particular, a camshaft having a tubular part that has at least one radial intake port for conducting a gas through the tubular shaft part, and comprising a splash guard that is mounted on the tubular shaft part at the radial intake port.

BACKGROUND OF THE INVENTION

Practical experience has revealed leakage losses in combustion engines and piston compressors that can be attributed to an incomplete seal. These leakage losses are identified as blowby gas and contain a significant amount of oil. The common approach with combustion engines is therefore to pass the blowby gas accumulating in the valve chamber back into the intake of the combustion engine. A known means for both the loss of oil through blowby gas while also ensuring optimal combustion and minimal impact on the environment is to separate oil from the blowby gas and to pass the separated oil back into the oil circulation system.

With a generic shaft, in particular a camshaft, evacuation of the blowby gas is effected through the tubular shaft part, and an oil separator can also be integrated directly into the tubular shaft part. One factor that must be taken into account is that the oil in the vicinity of a camshaft is frequently present in a wide variety of droplet sizes. Aside from the finest oil droplets that are contained in the blowby gas and are separated, for example by swirl generators, it frequently occurs that large oil droplets or splashed oil is observed in the area around a camshaft. Large oil droplets or splashed oil of this type can form, for example whenever an oil bath or oil foam is present at the camshaft. What can even occur in the worst cases is that a stream of oil reaches the shaft and, in particular, the tubular shaft part including the intake port for conducting the blowby gas.

Since implementing a follow-on separation of oil entails high costs, it is advantageous if large oil droplets, splashed oil, and oil streams can be kept away from the at least one intake port of the tubular shaft part in a generic shaft. Notwithstanding the ventilation and means of evacuating the blowby gas, it is then possible to keep the loss of oil as well as contamination of the downstream devices to a minimum. If a preferred embodiment has a downstream oil separator provided, for example inside the tubular shaft part, this oil separator then only has to separate the fine oil droplets from the blowby gas, thereby enabling an overall very efficient and reliable removal of oil to be achieved.

A shaft comprising the above-described features has been disclosed in EP 1 880 085 where a preseparator is provided on the outer surface of the shaft to separate oil, and a swirl generator integrated in the tubular shaft part is provided as the final separator. The preseparator is funnel-shaped and radially covers a plurality of radial intake ports of the tubular shaft part. The effective function as a splash guard is imperfectly achieved, however, since obliquely injected oil droplets or streams cannot be blocked. The preseparator is also of relatively costly design and requires a significant amount of installation space.

OBJECT OF THE INVENTION

In light of the above, the object of the invention is therefore to provide a shaft having a tubular part and at least one radial intake port in the tubular shaft part, and injection of large oil droplets or oil streams into the at least one intake port is substantially prevented.

SUMMARY OF THE INVENTION

Based on a shaft having the above-described features, the object is achieved according to the invention by an approach wherein the splash guard has a radially exposed jacket with radial holes and projections between the holes. What this design achieves is that essentially only blowby gas gets into the holes, and subsequently into the at least one intake port of the tubular shaft part, whereas large oil droplets, splashed oil, and oil streams are blocked so that the effectiveness of the splash guard typically increases as the speed of the shaft increases.

As the shaft rotates, the projections generate a gas flow in the rotation direction that at least partially prevents oil droplets from spinning inward or also an oil stream from being initially drawn in into the holes of splash guard, and thus also into the at least one intake port of the tubular shaft part. Another significant factor is that large oil droplets and splashed oil are not able to follow the rotation of the splash guard to the same extent as the blowby gas. Due to their inertia, the separation of oil droplets and splashed oil is enhanced at the projections as the shaft rotates, whereas the blowby gas can follow the rotational motion and flow into the holes. The holes are essentially walled off by the projections from the relatively inertially slow oil droplets and splashed oil, the projections being provided between the holes. The efficiency of this walling-off depends both on the shape of the projections, in particular, their height and orientation, and also on the volumetric flow rate of the blowby gas. As the volumetric flow rate of the blowby gas increases, a situation cannot under certain conditions be completely prevented whereby relatively large oil droplets are entrained and reach the tubular shaft part. Nevertheless, the inventive embodiment of the shaft comprising the above-described splash guard is characterized by a very efficient and substantial separation of the larger oil particles. Intrusion of oil can be effectively prevented even if the shaft, or in fact the splash guard, are partially immersed in an oil bath. An oil bath at the camshaft can occur during actual use when the engine is under extreme loads, for example, when there is an increased oil level in the cylinder head or during strong acceleration or braking maneuvers.

In a preferred embodiment of the invention, the splash guard can be implemented such that the fine oil droplets of the blowby gas are not separated. This type of oil separation from the blowby gas is preferably effected in a separate downstream oil separator that is provided, for example, in the form of a spiral or multiple spiral formations within the tubular shaft part. The invention provides the advantage, however, that this type of downstream oil separator is not additionally impacted by splashed oil or the like.

The invention provides a variety of especially advantageous capabilities in terms of the other embodiments of the shaft with the splash guard. The jacket thus preferably has a tubular center section from which the projections extend.

The tubular center section is advantageously of essentially cylindrical or slightly conical shape. The jacket thus has a simple shape on which the projections and holes can be easily provided.

The splash guard can be provided as a molded part, in particular, a cast part, thereby simplifying production. The splash guard can be shrunk on, as with cams, or secured in place by widening the tubular shaft part. However, since this involves a component that is mechanically under relatively low load, a simplified mounting is also possible. The splash guard can thus also be composed of segments, in particular, two axially divided segments. The individual segments are then installed on the region of the tubular shaft part at the at least one radial intake port, and securely clipped in place. The splash guard can be attached by adhesive to the tubular shaft part, or joined together from the segments. Additionally or alternatively, it is also possible to provide interacting positive-locking elements on the splash guard and the tubular shaft part, which elements effect attachment.

Aside from metal, it is also possible to consider using a plastic, ceramic, or other robust material for the splash guard, depending on the anticipated loads.

It is advantageous in terms of the general shape of the splash guard for it to be radially enlarged on one end, and preferably at both ends, as viewed axially of the shaft, for which purpose, for example, flange-like forms can be provided. With this embodiment, blowby gas can readily impinge on the radially exposed jacket, but drawn-in oil can be effectively blocked from reaching immediately adjacent fixtures of the shaft, such as for example cams, due to the expanded ends of the splash guard. Sizing the splash guard here must take into account the installation space that is available both axially and radially of the shaft.

It is advantageous in terms of the specific embodiment of the splash guard for the projections to be provided in the form of ribs that run straight or also with a slight oblique orientation in the axial axis of the shaft.

If the shaft is a camshaft, it will always have a predetermined direction of rotation. A preferred rotation direction is typically also specified for other shafts. As long as a predetermined or at least preferred rotation direction exists, the projections are advantageously oriented such that the separated oil is thrown outward during rotation in the predetermined or preferred rotation direction. The ribs in one embodiment can thus be angled in such a way that the free ends of the ribs point back in the predetermined or preferred rotation direction. This angle relative to a an orientation that runs precisely in the radial direction can measure, for example, between 10° and 40°, in particular, between 15° and 30°.

As explained above, the holes are protected due to the rotation of the projections between the holes. If the shaft has a predetermined or preferred rotation direction, it is advantageous for a projection to be provided immediately upstream of each hole as viewed in the rotation direction. Shielding of the holes from drawn-in oil is even further enhanced if the projections are angled back in the rotation direction, as described above, and thus to a certain extent cover the holes precisely as seen in the rotation direction.

The holes can be, for example, axial slots that run essentially parallel to the axis of the shaft. This then produces an especially advantageous embodiment in combination with ribs that run axially of the shaft.

The splash guard according to the invention is upstream from the at least one radial intake port of the tubular shaft part so as to effectively block oil from being drawn in. It is advantageous here for a radial gap to be provided between the jacket of the splash guard with the holes provided therein and the tubular shaft part with the at least one hole. In this type of embodiment, an offset can thus exist axially and/or circumferential direction of the shaft between the holes and the at least one intake port. The gap thus creates a flow passage for the gas to be evacuated, so that separation of the oil is possible due to the additional deflection. This at least prevents a situation where fast oil droplets can pass directly into the at least one intake port of the tubular shaft part.

Typically, a plurality of intake ports are provided in the tubular shaft part that are distributed uniformly angularly. The holes must be distributed accordingly angularly of the jacket for the splash guard so as to then achieve the described angular and/or angular offset. In particular, the number of holes can be a whole multiple of the number of intake ports.

An advantageous approach in this regard is for the projections and holes to be distributed angularly of the jacket group-wise, in particular, pair-wise, in a uniform arrangement. In a pair-wise arrangement, a first projection, a first hole, a second projection, and a second hole are provided respectively one directly behind the other.

As explained above, it is advantageous to provide a separate oil separator to separate the fine oil droplets from the blowby gas, which separator can be mounted inside the tubular shaft part. To accomplish this, a spiral swirl generator can be provided, for example, formed with one or more spiral passages, so that the fine oil droplets of the blowby gas are s thrown outward by the swirl motion and thus separated. By varying the pitch of the spiral passages, it is also possible to increase the flow rate in the direction of flow.

A bypass valve including a bypass passage connected thereto can also be provided inside the tubular shaft part in order to prevent excessive overpressure at the camshaft, the passage diverting the blowby gas past the oil separator.

BRIEF DESCRIPTION OF THE DRAWING

The following describes the invention based on a drawing that shows only one exemplary embodiment. Therein.

SPECIFIC DESCRIPTION OF THE INVENTION

Figure 1:
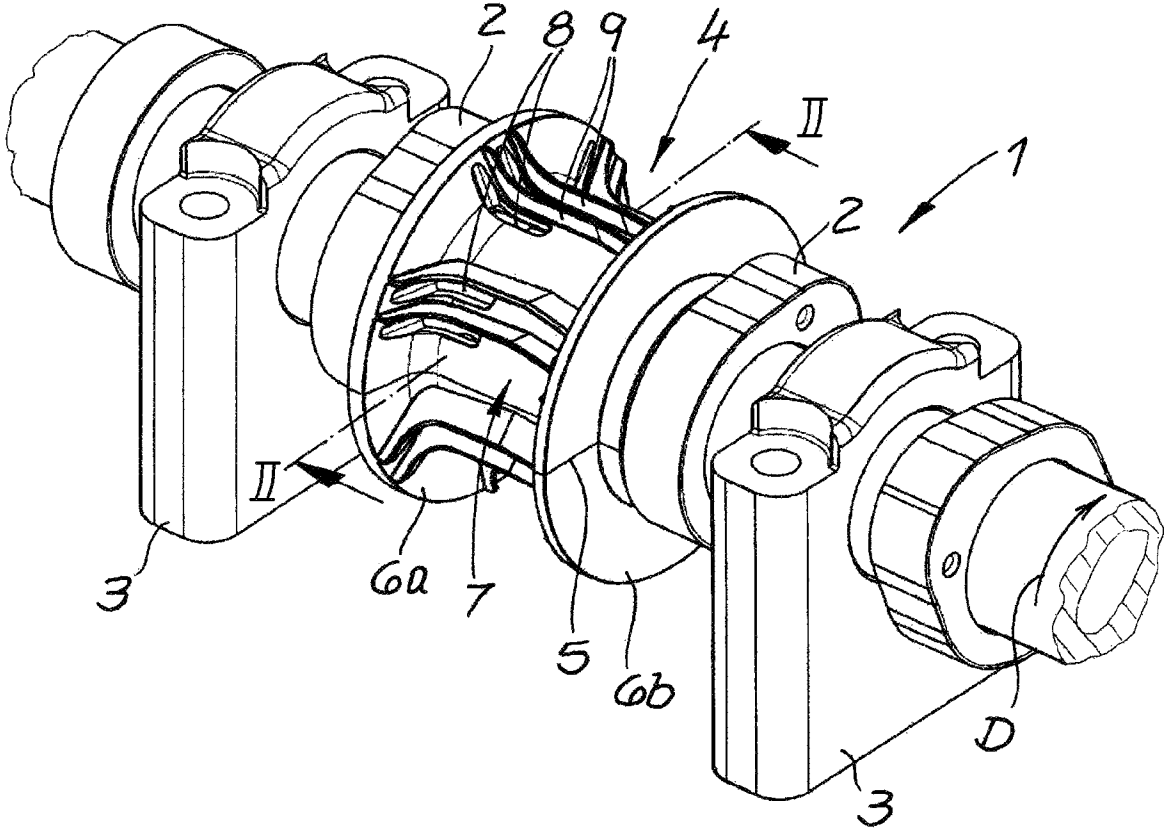
FIG. 1 shows an installation-ready camshaft assembly comprising a camshaft, which module is provided with splash guard.

FIG. 1 shows an installation-ready camshaft assembly comprising a camshaft 1 with a plurality of cams 2 of typical is construction and mounted in bearing or pillow blocks 3. A splash guard 4 is provided between adjacent cams 2, the function of the splash guard being explained in more detail below.

FIG. 1 shows here that the splash guard 4 is formed by two segments joined at an interface 5. Also shown is the fact that the splash guard 4 has flange-like widened ends **6*a* and 6*b* and a tubular, essentially cylindrical center section 7 therebetween. Holes 8 formed as axially extending slots, as well as projections formed as ribs 9** are seen that run axially of the shaft.

Figure 3:
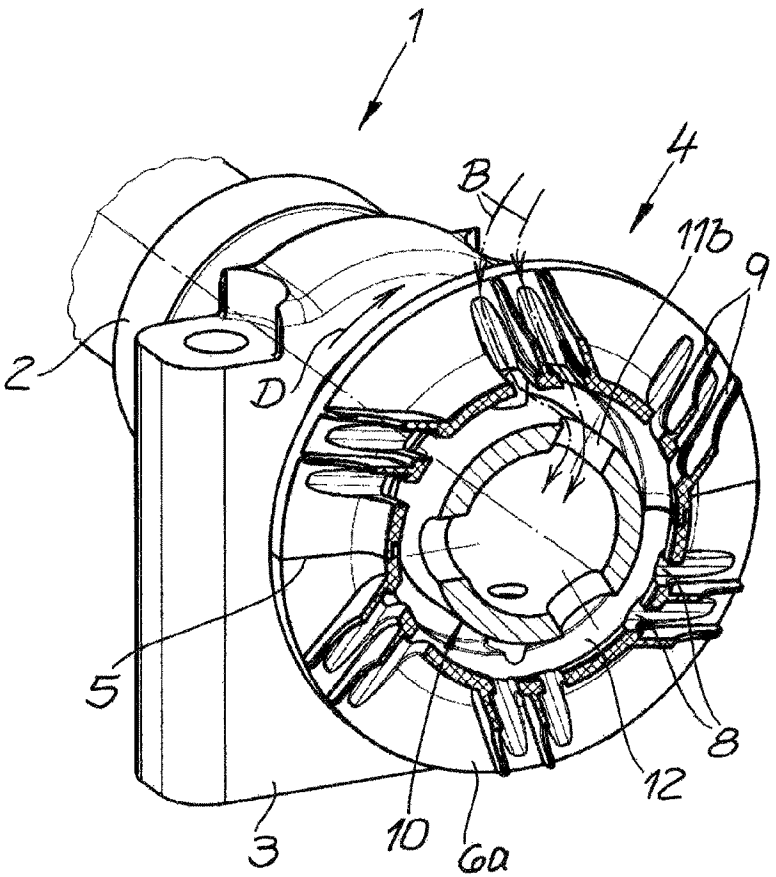
FIG. 3 is a perspective view of the section shown in FIG. 2.
Figure 2:
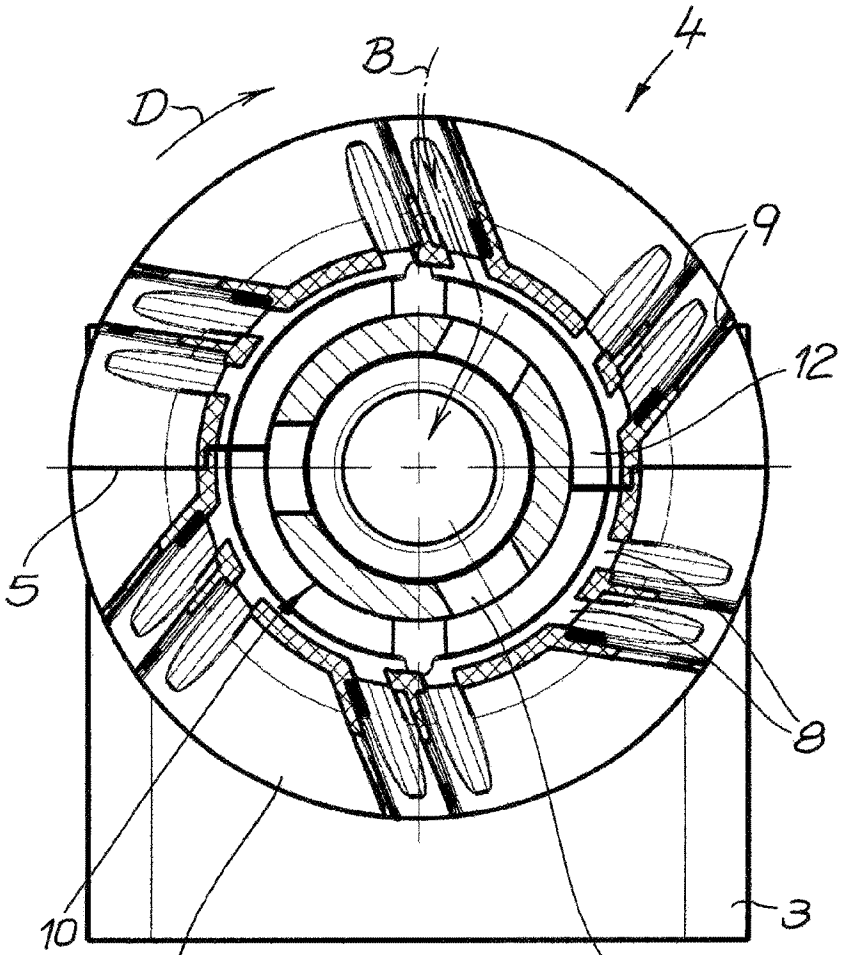
FIG. 2 is a top view of a section along line A-A in FIG. 1.
Figure 4:
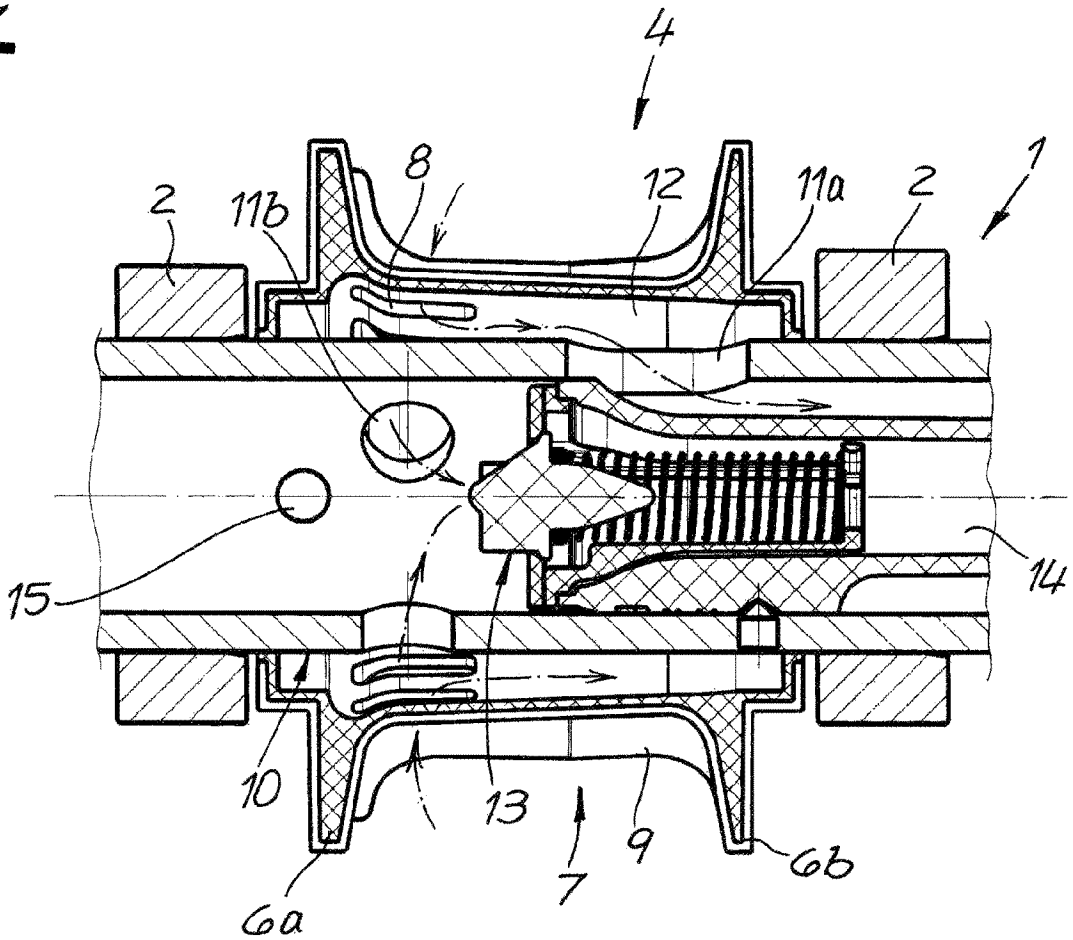
FIG. 4 is an axial section through the camshaft at the splash guard.

The purpose of the splash guard 4 and the exact configuration of the camshaft 1 is shown in FIGS. 2 through 4.

FIGS. 2 and 3 are similar cross-sections, the precise orientation of the ribs 9 and of the holes 8 being shown in the end cross-sectional view of FIG. 2. The perspective view of FIG. 3, on the other hand, taken together with FIG. 1, better shows the shape of the ribs 9 and the holes 8 extending axially of the shaft.

The sections first show that the camshaft 1 has a tubular shaft part 10 with at least one intake port—here a total of six radial intake ports 11*a* and 11*b*—for conducting blowby gas B through the tubular shaft part 10. The splash guard 4 here prevents large oil droplets or oil streams from being drawn directly into the radial intake ports 11*a* and 11*b*.

The ribs 9 and the holes 8 are provided for this purpose. As the camshaft 1 rotates in a predetermined rotation direction D, an angular flow of gas is generated that prevents large oil droplets or even a stream of oil from being drawn in. The blowby gas B, however, can follow the rotation of the camshaft 1 in response to a corresponding overpressure and enter the intake ports 11*a* and 11*b*. The path of the blowby gas B is indicated in the cutaway diagrams of FIGS. 2 through 4 by dot-dash lines.

In addition to the fact that a flow of gas is generated by the ribs 9, another factor here is that rotation of the splash guard 4 causes relatively large particles or streams to be deposited on the ribs 9 due to their inertia. FIG. 2 shows in this regard that one rib 9 is provided upstream of each hole 8 as viewed in the rotation direction D. Large oil droplets, splashed oil, and oil streams deposit on the ribs 9 before they can reach the holes 8.

FIG. 2 also shows that the ribs are angled relative to the predetermined rotation direction D so that their free ends point back in the predetermined rotation direction D. The angling can measure, for example, between 10° and 40°, in particular, between 15° and 30° relative to an orientation that runs exactly radially. The angle here measures approximately 25°. The described angle of the ribs 9 first of all enables the hole 8 to be even better protected as its opening is set slightly back from the respective rib 9. In addition, oil that has deposited on the rib 9 is also effectively driven radially outward and finally expelled by centrifugal forces.

The precise construction of the tubular shaft part 10 is seen in FIG. 4. Accordingly, the tubular shaft part 10 has different intake ports 11*a* and 11*b*. A radial gap 12 is created between the center section 7 of the splash guard 4 and the tubular shaft part 10, and the blowby gas B flows through this gap 12. Three intake ports 11*a* lead to an annular region within the tubular shaft part 10 that delivers blowby gas B to an unillustrated swirl generator for oil separation. A bypass valve 13 including a bypass passage 14 connected thereto is provided at the center of the tubular shaft part 10 to allow for rapid removal of the blowby gas in response to excessive overpressure even without cleaning. Blowby gas B from the gap 12 can also reach the bypass valve 13 through the additional intake ports 11*b*.

FIG. 4 shows that an axial offset is provided between the holes 8 of the splash guard 4 and the first intake ports 11*a*. Blowby gas B is thus deflected, thereby enabling even larger oil droplets to be separated during their deflection. In particular, there is no straight path along which oil droplets can reach the intake ports 11*a*.

As indicated in FIG. 2, at least one angular offset is provided for the additional intake ports 11*b* through which blowby gas B can reach the bypass valve 13. This is achieved by providing the holes 8 and the ribs 9 in groups that each include two of the holes 8 and two of the ribs 9. These six groups are then positioned such that intake ports 11*b* leading to the bypass valve 13 are exactly between two adjacent groups.

As explained above with reference to FIG. 1, the splash guard 4 is formed by segments, here two axially divided segments here. The interface 5 is seen between the two segments in FIGS. 2 and 3, where the segments can be joined by an adhesive, in particular, a two-component adhesive.

An adhesive can also attach the splash guard 4 to the camshaft 1. Additionally or alternatively, it is also possible to provide interacting positive-locking elements 15 on the splash guard 4 and the tubular shaft part 10, examples of which elements are shown in FIG. 4.

The invention claimed is:

1. A camshaft comprising:

a tubular part extending along and rotatable about an axis and formed with a radial intake port for conducting a gas radially into the radial intake port and axially through the tubular part;

a plurality of cams spaced along the tubular part; and a splash guard mounted on the tubular part at the radial intake port between adjacent cams for joint rotation with the tubular part and having a radially outwardly exposed and tubular center section coaxially surrounding the tubular part between the cams and formed with radially throughgoing holes and radially and axially extending ribs between and offset from the holes, the center section of the splash guard and the tubular shaft part forming a radial gap at the intake port, the holes being offset axially or angularly on the tubular shaft part from the intake port for gas flow into the openings, then axially or angularly along the gap around the tubular part, and then radially into the intake port and into the tubular part.

2. The shaft defined in claim 1, wherein the tubular part has a predetermined forward rotation direction, and the ribs are angled and have free ends that extend rearward relative to the predetermined forward rotation direction.

3. The shaft defined in claim 1, wherein the tubular part has a predetermined rotation direction, and a respective one of the ribs is provided upstream of each hole in the rotation direction.

4. The shaft defined in claim 1, wherein the holes are axial slots.

5. The shaft defined in claim 1, wherein the splash guard has radially enlarged ends as viewed axially of the shaft.

6. The shaft defined in claim 5, wherein each of the radially enlarged ends is juxtaposed with a respective one of the cams and the tubular center section extends between the radially enlarged ends.

7. The shaft defined in claim 1, wherein the ribs and the radially throughgoing holes are distributed in a uniform arrangement pair-wise angularly of the center section.

8. The shaft defined in claim 1, further comprising:

a bypass valve inside the tubular shaft part.

9. The shaft defined in claim 1, wherein the splash guard is composed of two axially joined segments.

10. The shaft defined in claim 1, wherein the splash guard is bonded with adhesive to the tubular shaft part.

11. The shaft defined in claim 1, wherein the splash guard and the tubular part include interfitting positive-locking elements.

12. The shaft defined in claim 1, wherein the tubular center section is spaced radially outward by the gap from the tubular part.

* * * * *